US007337542B2

(12) United States Patent
Brazin et al.

(10) Patent No.: US 7,337,542 B2
(45) Date of Patent: Mar. 4, 2008

(54) METHOD FOR MANUFACTURING HOUR-SYMBOLS AND INSTALLATION FOR IMPLEMENTING THE SAME

(75) Inventors: Jean-Luc Brazin, Publier (FR); Pierre-Andre Buhler, Orvin (CH)

(73) Assignee: Nivarox-Far S.A., Le Locle (CH)

( * ) Notice: Subject to any disclaimer, the term of this patent is extended or adjusted under 35 U.S.C. 154(b) by 384 days.

(21) Appl. No.: 11/038,174

(22) Filed: Jan. 21, 2005

(65) Prior Publication Data

US 2005/0160574 A1 Jul. 28, 2005

(30) Foreign Application Priority Data

Jan. 26, 2004 (EP) ..... 04001596

(51) Int. Cl.
*G04D 3/00* (2006.01)

(52) U.S. Cl. ..... 29/896.32

(58) Field of Classification Search ..... 29/896.32, 29/896.3, 557; 968/154; 82/173
See application file for complete search history.

(56) References Cited

U.S. PATENT DOCUMENTS 2,761,198 A * 9/1956 Stern ..... 29/896.32
3,277,562 A * 10/1966 Huguenin ..... 29/896.32
3,287,798 A * 11/1966 Beyeler et al. ..... 29/896.32
3,323,396 A 6/1967 Kochli
3,433,013 A * 3/1969 Kohli et al. ..... 368/232

FOREIGN PATENT DOCUMENTS

| | | |
|---|---|---|
| CH | 1 714 066 D | 12/1968 |
| CH | 1 680 168 D | 11/1970 |
| CH | 506 111 | 4/1971 |
| CH | 565 406 | 9/1972 |
| FR | 1 403 178 A | 6/1965 |
| FR | 2308133 | 11/1976 |

OTHER PUBLICATIONS

European Search Report, completed Aug. 10, 2004.

* cited by examiner

*Primary Examiner*—John C. Hong
(74) *Attorney, Agent, or Firm*—Griffin & Szipl, P.C.

(57) ABSTRACT

The method consists, from a profile having a section corresponding either to the envelope of the base of the symbol or to that of its section, in first of all machining the feet, transferring the preformed profile in a clamp, gripping the symbol by the feet, cutting the preform, shaping and diamondpolishing all of the visible faces of said symbol, and transferring said finished symbol into an individual packing tray using a robot.

8 Claims, 3 Drawing Sheets

METHOD FOR MANUFACTURING HOUR-SYMBOLS AND INSTALLATION FOR IMPLEMENTING THE SAME

This application claims priority from European Patent Application No. 04001596.8 filed Jan. 26, 2004, the entire disclosure of which is incorporated herein by reference.

FIELD OF THE INVENTION

The present invention concerns a method of manufacturing hour symbols added to the dial of a timepiece by means of securing feet for replacing all or part of the numbers indicating the hours, said symbols being of very small dimensions and generally having simple geometrical shapes.

The invention also concerns a robotized installation for individually machining said symbols thereby offering great freedom of choice as to shape and a higher finishing quality of the surface state of the visible parts after they are fixed to the dial.

BACKGROUND TO THE INVENTION

The symbols or numbers disposed on the hour-circle, or on secondary dials, are usually made by transferring, or by screen printing, giving the impression that they are printed. These symbols can also be obtained by dying the lower surface of the dial, the parts in relief forming the symbols then being polished, varnished or covered with a luminescent pigment, as described for example in FR Patent No. 2 308 133. These symbols can also be parts added to the dial being produced by stamping a metal plate, then by bonding, for example using a hot setting adhesive, as indicated in CH Patent No. 506 111.

When one wishes to obtain high quality pieces, in particular when the metal used is a precious metal, the symbols, which are then usually provided with feet for securing them to the dial by driving them into housings provided for such purpose, are roughed out by machining or stamping a profile, then taken to be faceted. The sections employed are generally rectangular, either along a "longitudinal" mode, or along a "transverse" mode.

According to the first embodiment, the profile has a section in which a cross section of a symbol, including the feet, can be inscribed. Over a certain profile length corresponding to several symbols placed end-to-end, a face is first machined to form the definitive appearance of the visible part of the symbols, then the feet are formed by milling the opposite face. The symbols are then cut off and fall into a tank for the subsequent cleaning and drying operations before being packed in bulk for dispatch. One embodiment of this type is described in more detail for example in U.S. Pat. No. 3,323,396. This method has the drawback of not allowing the cut off part to be finished, for example by diamondpolishing. There also exists a risk of the feet, which are very fine little rods with a diameter of less than a millimeter, being damaged when dropped into the container, which can lead to a discard rate of 30% or even more.

According to a second embodiment, the profile has a section in which the contour selected for the base of a symbol can be inscribed. In a first operation, the upper faces and sides of the symbols are diamondpolished. In a second operation, the symbol is gripped on two opposite support surfaces between the jaws of a hard metal clamp to be cut along a length substantially corresponding to the thickness of the symbol, increased by the height of the feet. In a third operation, the feet are milled, then the symbols are released and they drop into a tank for the subsequent bulk cleaning and drying operations, before being packed. According to a variant of this embodiment, disclosed in CH Patent No. 565 406, the end of the profile is gripped by a clamp over a length corresponding to the length of the feet, then a section is cut off and brought by a revolving table before a faceting station, then before a turret where it is picked up by another clamp on opposite sides that have already been faceted, in order to the two feet to be milled in succession. As can be seen, in this embodiment, in which finished surfaces are gripped between clamps in order to execute the final machining of the feet, there is a high risk of producing symbols with visible defects in appearance causing them to be downgraded or even rejected when said symbols are intended for top of the range timepieces.

SUMMARY OF THE INVENTION

It is thus an object of the present invention to overcome the drawbacks of the aforecited prior art by providing a method and an installation for implementing the same for manufacturing hour symbols ideally having no defects in appearance and allowing great flexibility as regards their shape.

Thus, from a metal profile having a suitable section, the method according to the invention enables hour symbols to be manufactured by individual machining with at least one securing foot in the dial of a timepiece. The method includes the following basic steps:

- in a first step a preform is made and the feet are milled in one end of the profile,
- in a second step, the feet are gripped by clamp and the preform is cut, and
- in a third step, the symbol is machined and diamondpolished on all of its visible surfaces to the desired shape.

The method further includes secondary steps, consisting of:

- gripping the finished symbol with a suction device to separate it from the clamp and placing it in an individual packing tray,
- cleaning and drying a set of several trays each containing a batch of symbols arranged on the tray, and
- packing the trays for dispatch.

As can be seen, there is not, at any stage of the method, any taking up again by the clamps, nor any bulk processing, so that there are no defective parts, which is particularly advantageous from the economical point of view, especially when the metal of the profile is a precious metal such as gold, or a gold alloy.

According to a preferred embodiment, the feet are milled at the end of the profile.

This method is implemented using a robotized installation with numerical control (CNC) that can be programmed to generate symbols of very varied shapes. The installation includes a profile feed magazine, mobile horizontally on a slide along an axis $Z_2$ facing clamps for gripping the symbols by the feet. Machining is carried out by means of a robot with four degrees of freedom ($X$, $Y$, $Z_1$, $\vartheta$) arranged between the magazine and the clamps, The installation also includes a manipulator arm for gripping parts by suction.

BRIEF DESCRIPTION OF THE DRAWINGS

Other features and advantages of the present invention will appear upon reading the following detailed description, with reference to the annexed drawing, in which.

DETAILED DESCRIPTION OF THE INVENTION

Figure 1:
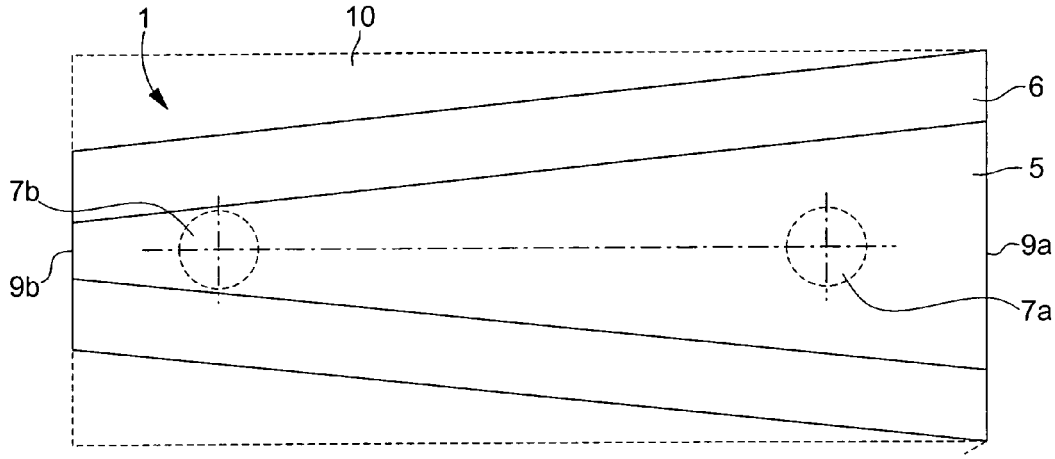
FIG. 1 shows a top view of an example symbol able to be manufactured in accordance with the method of the invention.
Figure 2:
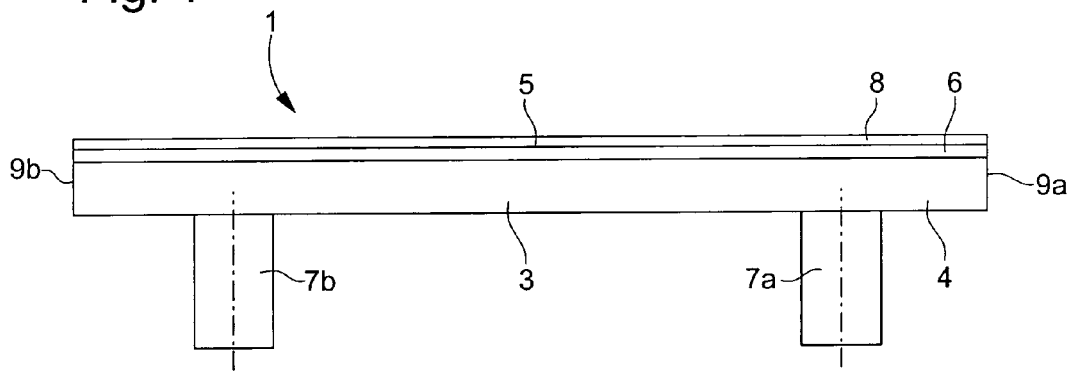
FIG. 2 shows the same symbol as that of FIG. 1 in a side view.
Figure 3:
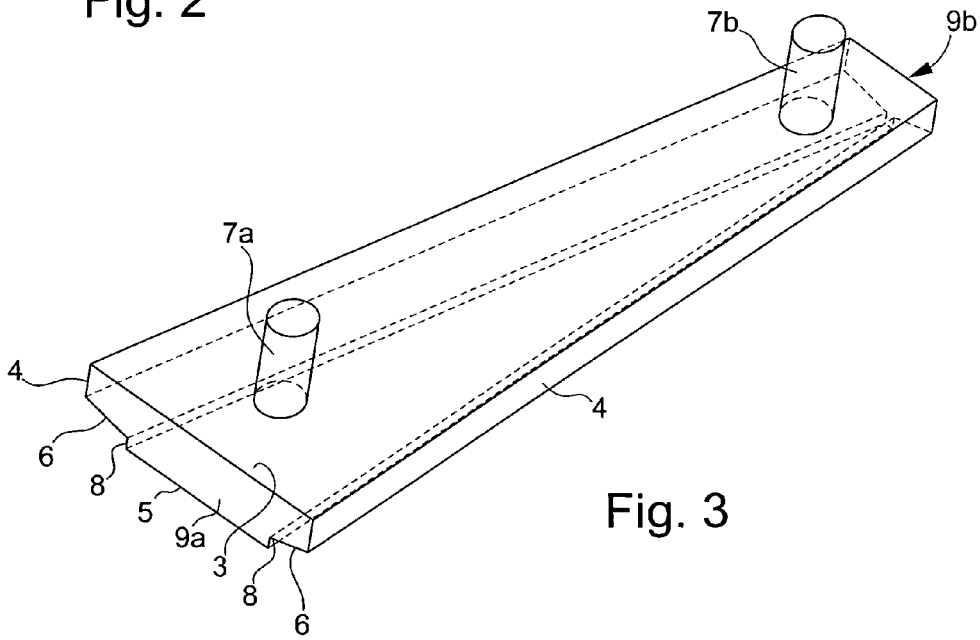
FIG. 3 shows a perspective bottom view of the symbol of FIG. 1.

With reference to FIGS. 1 and 3, there is shown in very large scale, a symbol, the visible part of which has the shape of two superposed isosceles trapezoids 3, 5 that are symmetrical with respect to the centre line. The larger trapezoid 3, which forms the base of the symbol that will be secured to the dial, is connected to the smaller trapezoid 5 by a vertical flank 4, a sloping plane 6 and by another vertical flank 8. In the embodiment described, the base formed by the large trapezoid 3 includes two feet 7*a*, 7*b*, located in the mid-plane of the symbol and integral with the trapezoidal plate. Of course, the symbol could include only one foot. Purely by way of indication, the length of the symbol is of the order of 3 mm, its largest width of the order of 1.50 mm and its total height, including the feet, is of the order of 0.75 mm, such that the profile 10 (shown in dotted lines in FIG. 1) used to make it can have a rectangular section slightly greater than $3\times1.5$ mm$^2$.

It would also be possible to manufacture the same symbols from a profile having an isosceles trapezoid section slightly greater than the base of the symbols, taking account of the diamondpolishing operations. As will be seen hereinafter, the method also enables symbols with no vertical flank to be manufactured, faces 4, 6 and 8 as well as ends 9*a*, 9*b*, having a rounded shape.

With reference now to FIGS. 4 to 7, an embodiment of the method according to the invention will now be described. The rough material for manufacturing the symbols is formed by a profile 12 of rectangular section 10. It may be, for example, a gold bar 2 metres in length.

Figure 4:
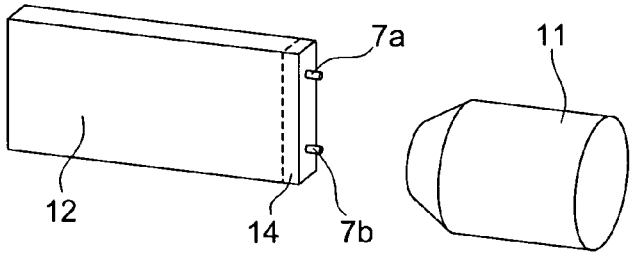
FIG. 4 shows the first step of the method for forming the feet.

In a first step "a" shown in FIG. 4, two feet 7*a*, 7*b* are shaped using a face mill attached to a milling spindle 11. Purely by way of indication, the height of feet 7*a*, 7*b* is greater than or equal to 0.03 mm and the diameter thereof is around 0.25 mm.

Figure 5:
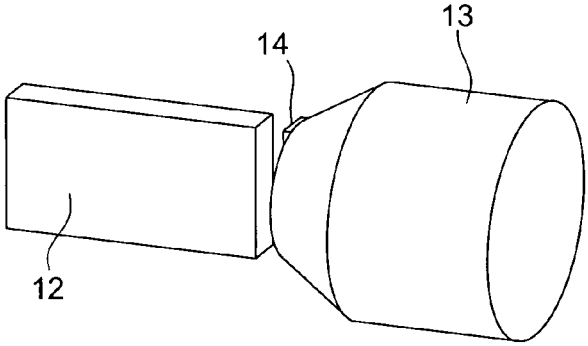
FIG. 5 shows the second step leading to the cutting of a preform for manufacturing a symbol.

Despite such small dimensions, and surprisingly, the feet have sufficient mechanical resistance to be able to be gripped by a clamp 13, which, in the example shown in FIG. 5, is the spindle of a tailstock. In this second step "b", a preform 14 is cut out of profile 12.

Figure 6:
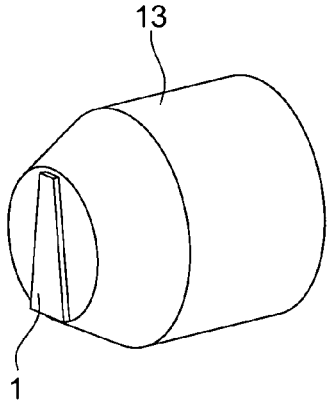
FIG. 6 shows the symbol presented for the third shaping and diamond polishing step.
Figure 7:
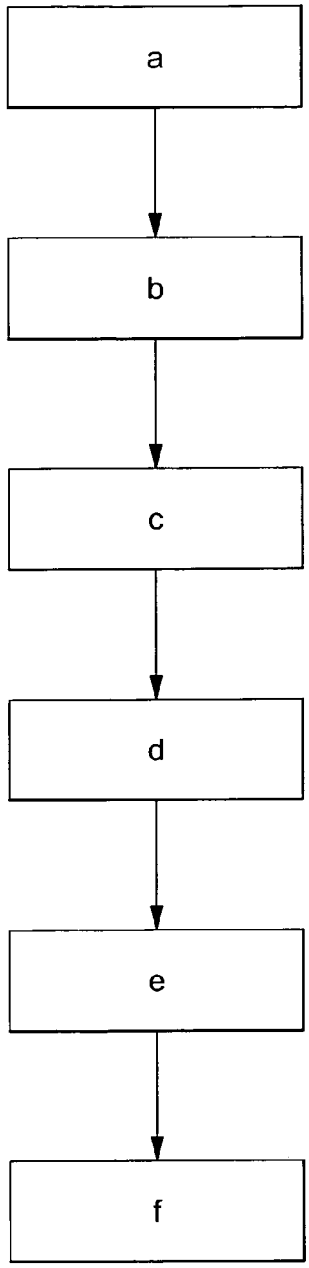
FIG. 7 is a flow chart showing again the first three steps and the following steps up to packing for dispatch.

In a third step "c", shown in FIG. 6, as preform 14 is still held by feet 7*a*, 7*b*, it can be given the desired shape and all of the visible surfaces can be diamondpolished to obtain a finished symbol 1, none of whose surfaces show any clamp marks.

It will also be noted that, since all of the handling is carried out by gripping the feet it is no longer necessary to have two parallel flanks and that the visible part of the symbol can comprise only curves and have, for example, the shape of a drop of water.

The following steps d, e, f concern the final operations prior to dispatch. In step "d", symbol 1 is removed from tailstock by a manipulator arm including a suction grasping device and deposited in a tray able to contain, for example, a batch of 100 symbols. In a step "e", the symbols arranged on the trays are washed and dried. In a last step "f" the same trays are wrapped up, for example with a retractable plastic film to hold the symbols in place for the purpose of dispatch.

The method that has just been described corresponds to that designated in the preamble as a "transverse embodiment". Without departing from the scope of the invention, one can also envisage a longitudinal embodiment, the first step "a" then consisting in machining the feet, not in the section of the profile, but in one of its faces, then in the second step "b" in gripping the preform by its feet, the following steps remaining unchanged. In this variant, the profile can advantageously be T-shaped, the width of the vertical bar being the diameter of the feet.

Figure 8:
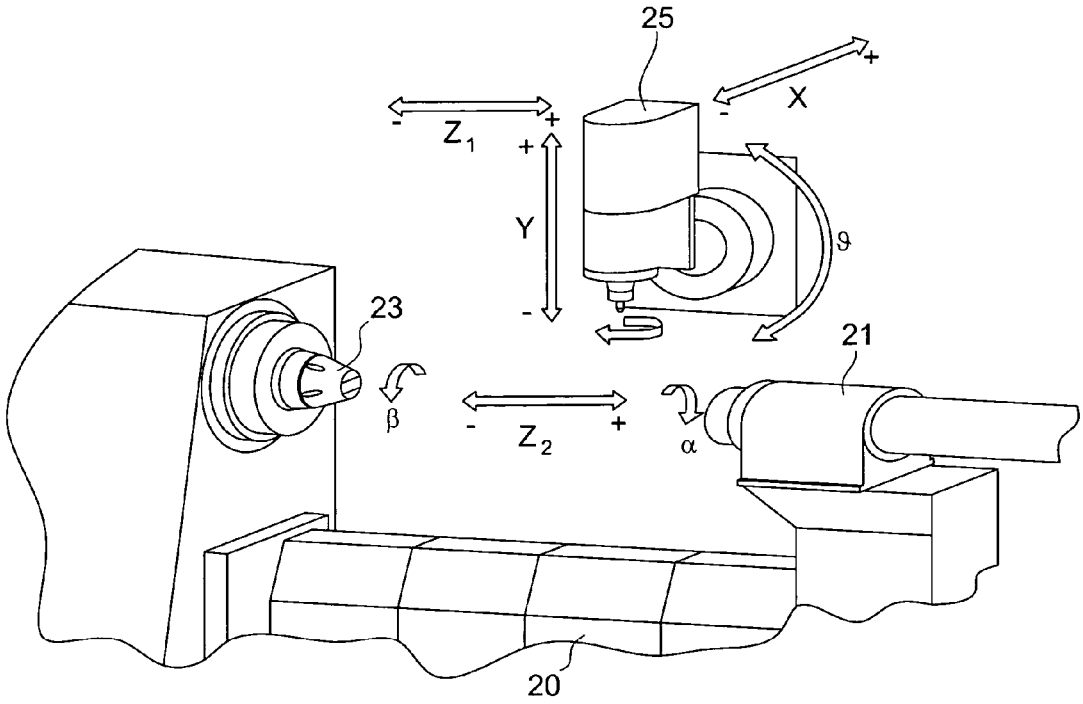
FIG. 8 is a schematic diagram of an automated machine for implementing the method.

FIG. 8 shows schematically by way of example an installation for implementing the method, particularly when the feet are machined at the end of the profile. The installation includes a profile feed magazine 21, mobile on a slide 20 along an axis $Z_2$ facing a clamp 23, these two elements also having a degree of freedom in rotation $\alpha$, $\beta$ about axis $Z_2$. A tool carrier robot 25 with four degrees of freedom (X, Y, $Z_1$, $\vartheta$) is disposed between magazine 21 and clamp 23. The installation also includes a manipulator arm (not shown) for gripping pieces by suction, the assembly being driven by a programmable CNC for generating symbols individually with very varied shapes. In a first step, magazine 21, by moving on slide 20 along axis Z2, positions itself opposite robot 25 in order to machine a first foot, then by rotating through an angle $\alpha=180°$ in order to machine the second foot. Robot 25 withdraws and magazine 21 moves forward as far as clamp 23, which grips the feet. Robot 25 then moves along axis $Z_1$ to cut the preform in a second step and magazine 21 moves back to its initial position. In a third step, the robot moves along axis $Z_1$ towards clamp 23 to carry out the diamondpolishing operations owing to its four degrees of freedom and the orientation of the preform made possible by a rotation $\beta$ of the clamp. The subsequent unloading, washing, drying and packing operations will not be described since they are usual operations in this field.

What is claimed is:

1. A method of manufacturing hour symbols with feet and visible surfaces, for securing the base of said symbols to a dial, from a metal profile, comprising the steps of:

a first step in which the feet are milled in one end of the profile and a preform is preformed, a second step in which the feet are gripped in a clamp and the preform is cut, and a third step in which the preform is finished in the shape desired for the symbol and all visible surfaces are diamondpolished.

2. The method according to claim 1, wherein it further includes the following steps:

gripping the finished symbol via a suction device to separate it from the clamp and placing it in an individual packaging tray, washing and drying a set of several trays each containing a batch of symbols disposed on the tray, and packing the trays for dispatch.

3. The method according to claim 1, wherein, in the first step, the feet are milled at the end of the profile.

4. The method according to claim 3, wherein the profile has the same shape as the base of a symbol with a slightly larger section.

5. The method according to claim 1, wherein, in the first step, the feet are milled on one surface of the profile.

6. The method according to claim 1, wherein the profile has a rectangular cross section in which either the section of the symbol with its feet, or the contour of the base of said symbol can be inscribed.

7. The method according to claim 1, wherein the symbols obtained do not have opposite vertical flanks.

8. The method according to claim 1, wherein the profile is made of gold or gold alloy.

* * * * *